United States Patent [19]

De Bijl et al.

[11] 4,339,693

[45] Jul. 13, 1982

[54] ARRANGEMENT INCLUDING A GAS AND/OR VAPOR DISCHARGE LAMP

[75] Inventors: Adrianus M. J. De Bijl; Johannes A. De Vogel, both of Eindhoven, Netherlands

[73] Assignee: U.S. Philips Corporation, New York, N.Y.

[21] Appl. No.: 207,320

[22] Filed: Nov. 17, 1980

[30] Foreign Application Priority Data

Dec. 19, 1979 [NL] Netherlands ..... 7909127

[51] Int. Cl.[3] ..... H05B 41/16

[52] U.S. Cl. ..... 315/225; 315/227 R; 315/289; 315/308; 315/DIG. 7

[58] Field of Search ..... 315/207, 225, 227 R, 315/244, 289, 290, 307, 308, 310, DIG. 7, 208

[56] References Cited

U.S. PATENT DOCUMENTS 3,449,629 6/1969 Wigert et al. ..... 315/308 X
4,087,723 5/1978 Chermin et al. ..... 315/207
4,240,009 12/1980 Paul ..... 315/307 X

FOREIGN PATENT DOCUMENTS 53-74772 7/1978 Japan ..... 315/207

*Primary Examiner*—Eugene R. LaRoche
*Attorney, Agent, or Firm*—Robert T. Mayer; Bernard Franzblau

[57] ABSTRACT

The invention relates to an arrangement comprising a gas and/or vapor discharge lamp (5) which includes a discharge tube (5*a*). An electronic auxiliary device (10–16) is arranged in parallel with the discharge lamp (5). This auxiliary device ensures that in the operating condition the lamp is shunted briefly during each half cycle of the power supply.

With an arrangement according to the invention, the lamp (5) is of a type in which the discharge tube (5*a*) has a temperature of at least 200° C. in the operating condition. The auxiliary device is connected to sensor elements (20; 25–28) which ensure that the lamp (5) is not shunted in the period of time in which the lamp (5) has not yet reached the operating condition. This achieves reliable starting of the lamp.

8 Claims, 1 Drawing Figure

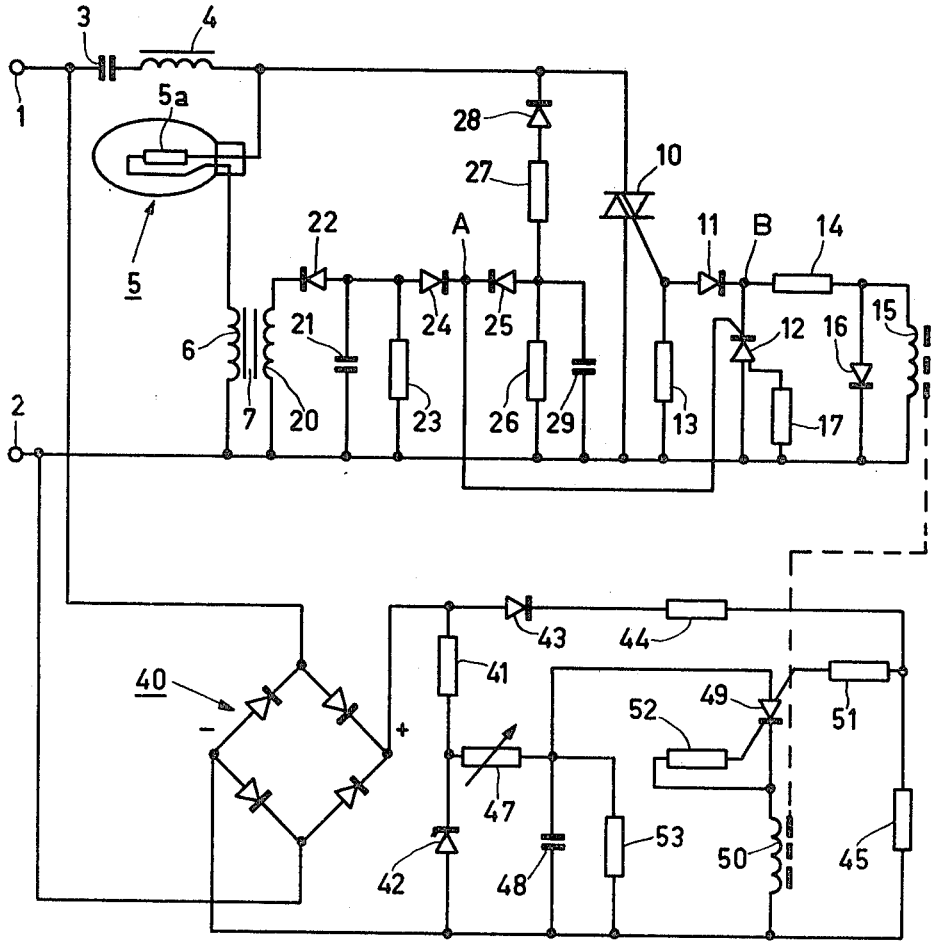
3
4
1
5a
5
28
27
10
22
A
11
B
14
6
21
24
25
12
16
15
2
7
20
23
26
29
13
17
43
44
40
41
49
52
51
47
53
50
45
42
48

ARRANGEMENT INCLUDING A GAS AND/OR VAPOR DISCHARGE LAMP

The invention relates to an arrangement comprising a gas and/or vapour discharge lamp having a discharge tube, and two terminals which are intended for connection to an a.c. voltage source, in which arrangement the terminals are interconnected by a series arrangement of at least the discharge tube and a stabilization ballast which includes a capacitor, a portion of the series arrangement which includes the discharge tube but not the capacitor is shunted by an electronic auxiliary device, this auxiliary device comprising a branch including a controlled semi-conductor switching element provided with a control circuit, the semiconductor switching element being rendered conductive in the operating condition of the lamp in substantially each half cycle of the supply by means of its control circuit, the control of the semi-conductor switching element being different during starting of the lamp from that during the operating condition of the lamp.

The invention also relates to an electronic auxiliary device which is particularly suitable for an arrangement as specified above.

An arrangement of the above-mentioned type has already been proposed in the prior, non-prepublished, Netherlands patent application 7,806,889. An advantage of that prior arrangement is that the stabilisation ballast of the lamp is relatively small. However, a disadvantage thereof is that it is not suitable for starting a discharge tube which has an average temperature of at least 200° C. in the operating condition.

It is an object of the invention to provide an arrangement of the type described in the opening paragraph, which does not have this disadvantage.

The invention accordingly provides an arrangement comprising a gas and/or vapour discharge lamp having a discharge tube, and two terminals which are intended for connection to an a.c. voltage source, in which arrangement the terminals are interconnected by a series arrangement of at least the discharge tube and a stabilisation ballast which includes a capacitor, a portion of the series arrangement which includes the discharge tube but not the capacitor is shunted by an electronic auxiliary device, this auxiliary device comprising a branch including a controlled semi-conductor switching element provided with a control circuit, the semiconductor switching element being rendered conductive in the operating condition of the lamp in substantially each half cycle of the supply by means of its control circuit, the control of the semiconductor switching element being different during starting of the lamp from that during the operating condition of the lamp, characterized in that the discharge tube is of a type which has an average temperature of at least 200° C. in the operating condition of the lamp, and the control circuit of the semi-conductor switching element includes a sensor element coupled to the said series arrangement which reduces the conduction period of the semi-conductor switching element per unit of time so long as, in the switched-on condition of the arrangement, the condition of the lamp differs from its operating condition.

An advantage of this electric arrangement is that it enables, by means of the electronic auxiliary device, reliable starting of the lamp.

The invention is based on the recognition of the fact that the disadvantage of the electric arrangement proposed in the above-mentioned Netherlands patent application 7,806,889 (PHN 9169) must be ascribed to the fact that when it is tried to ignite a discharge tube which has an average temperature of at least 200° C. in the operating condition, the fact that the semiconductor switching element conducts for a relatively long period of time-during the starting procedure of the discharge tube—prevents the tube from receiving sufficient current to warm-up. It was recognized that suppressing the conduction of the first semi-conducting switching element wholly or partly during the lamp starting procedure—inclusive of warming-up of the lamp—can result in a proper lamp start. A sensor element is therefore provided to check whether the lamp has reached its operating condition.

The sensor element may, for example, be a photosensitive resistor facing the discharge tube of the lamp. This photo-sensitive resistor is, for example, included in a branch leading to the control electrode of the first controlled semi-conductor switching element. When the lamp has not yet assumed its operating luminance, a control signal which is sufficient to render the semi-conductor switching element conductive is not applied to this switching element.

In an embodiment of an electric arrangement according to the invention, the sensor element consists of a secondary winding of a transformer and a primary winding of that transformer is included in the series arrangement connecting the terminals of the arrangement and comprising the discharge tube. An advantage of this embodiment is that the sensor element need not be arranged close to the lamp since there is no need for the element to intercept light.

In an improvement of the said embodiment of an electric arrangement according to the invention in which the lamp is of a type for which the arc voltage increases during warming-up of the discharge tube, the series arrangement of the discharge tube and the primary winding of the transformer is shunted by the first controlled semi-conductor switching element and also by an input branch of a second sensor element, which input branch includes a voltage divider. An advantage of this improvement is that it is not only possible to determine, by means of the first sensor element, whether a current of a sufficient intensity is present in the lamp, but that it is also possible to check by means of the second sensor element whether the arc voltage associated with the operating condition of the lamp has been reached. If neither the current intensity through the lamp nor the arc voltage of the discharge tube has been reached, it is possible to ensure with the control circuit of the semi-conductor switching element that this switching element is rendered conductive only for a short period of time or is not rendered conductive at all.

As a rule the two sensor elements will have been adjusted so that, when the operating condition of the lamp has been reached, it is no longer possible to prevent the first controlled semiconductor switching element from being rendered conductive, for not until then is the situation obtained which renders it possible to operate the discharge lamp with a relatively small stabilisation ballast.

In an alternative embodiment, the first semiconductor switching element has a bidirectional thyristor characteristic and its control circuit is provided with a second controlled semiconductor switching element, a control electrode and a main electrode of the first switching element being interconnected via the second switching element and also being connected to a control pulse generator, and a control electrode of the second switching element is connected to an auxiliary power supply and to a circuit comprising the secondary transformer winding such that, the arrangement having been switched on but the lamp current being absent, the second switching element is rendered conductive by means of the auxiliary power supply. An advantage of this embodiment is that the first semiconductor switching element is kept non-conductive in a reliable manner during starting of the lamp, i.e. when no lamp current flows.

The auxiliary supply may consist of a separate supply source, for example a battery. In a further embodiment of an arrangement according to the invention the auxiliary supply is provided by a tap on the voltage divider of the second sensor element. An advantage thereof is that no separate supply source is required.

In an improvement of the last embodiment of an electric arrangement according to the invention, the secondary transformer winding is shunted by a series arrangement of a second capacitor and a first rectifier, the second capacitor being shunted by a resistor, and a second rectifier is connected to the junction of the second capacitor and the resistor, and a third rectifier which forms part of the auxiliary supply is connected to that second rectifier, the forward directions of the second and third rectifiers facing one another, the other side of the third rectifier being connected to the tap of the voltage divider of the second sensor element, a fourth rectifier being included in series with the voltage divider, a portion of the voltage divider being shunted by a third capacitor, and the connection from the control electrode of the second switching element to the circuit of the secondary transformer winding being connected to a junction point between the second and third rectifiers. An advantage of this embodiment is that it furnishes a simple combination of the two sensor elements in the control circuit of the first semiconductor switching element.

The control pulse generator may, for example, be in the form of a separate unit with a supply of its own.

The said control pulse generator may also be connected to the input terminals of the arrangement and may comprise an output transformer, the second switching element being connected across the secondary winding of that transformer. An advantage of this embodiment is that the control pulse generator does not then require a separate supply of its own. A further advantage is that the supply of the control pulse generator is not influenced by the fact that the first semiconductor switching element is conductive. This would be the case if the generator were connected across the discharge lamp.

Finally, the invention also relates to an electronic auxiliary device for operating a discharge lamp which is connected in series with a stabilization ballast which includes a capacitor, the device having two input terminals interconnected by a controlled semiconductor switching element, a control circuit of which element comprises two sensor elements, one sensor element including a winding which is intended for electric coupling to a winding in the series circuit of the lamp to be operated with this electronic auxiliary device, the other sensor element including a series arrangement of a voltage divider and a rectifier, this series arrangement shunting the semiconductor switching element.

An embodiment of the invention will now be further explained by way of example with reference to the accompanying drawing, the sole FIGURE of which shows a circuit of an arrangement according to the invention.

In the FIGURE, reference numerals 1 and 2 denote terminals which are intended for connection to an a.c. voltage source of approximately 118 volts 60 Hz. Terminal 1 is connected to a stabilisation ballast consisting of a capacitor 3 arranged in series with a coil 4. The coil 4 is connected to one terminal of a high-pressure mercury vapour discharge lamp 5 which includes a discharge tube 5*a*. The other terminal of the lamp 5 is connected to the input terminal 2 via a primary winding 6 of a transformer 7. The circuit portion described so far is the supply circuit of the lamp 5. The discharge 5*a* has two internal electrodes (not shown).

The discharge lamp 5 is a 250 Watt lamp and the average temperature of the discharge tube 5*a* is approx. 550° C. in the operating condition, i.e. above 200° C. During starting of the lamp, that is to say from a temperature which is the same as the ambient temperature upwards to the above-mentioned operating temperature, the arc voltage of the lamp increases from 10 Volts to approx. 120 Volts in the operating condition. The normal operating current through the discharge tube is approx. 2.5 A.

The FIGURE also shows an electronic auxiliary device which is denoted by the reference numerals 7 to 14, inclusive, and also 16 to 29, inclusive. The FIGURE also shows a control pulse generator, denoted by the reference numerals 15 and 40 to 53, inclusive.

The electronic auxiliary device will be described first. This device comprises a first controlled semiconductor switching element (Triac) 10, having a bi-directional thyristor characteristic. This switching element 10 shunts the series arrangement of the lamp 5 and the primary winding 6. A control electrode of the switching element 10 is connected to a second controlled semiconductor switching element 12 via a rectifier 11. The other end of this switching element 12 is connected to a main electrode of the switching element 10. This main electrode is connected to the control electrode of the switching element 10 via a resistor 13. A junction B between the rectifier 11 and the switching element 12 is connected to a resistor 14. This resistor 14 is connected to a parallel arrangement of a secondary transformer winding 15, of the control pulse generator, and a rectifier 16. The other side of this parallel arrangement is connected to the input terminal 2.

A first control electrode of the second switching element 12 is also connected to the input terminal 2 via a resistor 17. A second control electrode of that switching element 12 is connected to a junction point A in a circuit associated with a secondary transformer winding 20 (first current sensing element) of the transformer 7. The winding 20 is shunted by a series arrangement of a capacitor 21 and a rectifier 22. In its turn, the capacitor 21 is shunted by a resistor 23. A junction between the rectifier 22 and the resistor 23 is connected to a second rectifier 24. The other side of the rectifier 24 is connected to the point A and to a fourth rectifier 25. The forward directions of the rectifiers 24 and 25 both point towards the point A. The other side of the rectifier 25 is connected to a tap of a voltage divider consisting of the resistors 26 and 27. A series arrangement of these resistors and a further rectifier 28 shunts the first semiconductor switching element 10. This series arrangement is the input branch of a second sensor element, namely a voltage sensor. In addition, the resistor 26 of the voltage divider is shunted by a capacitor 29. This ends the description of the electronic auxiliary device of the circuit.

There now follows the description of the control pulse generator of this lamp circuit. Reference numeral 40 denotes a rectifier bridge whose input terminals are connected to the terminals 1 and 2 of the arrangement. Two output terminals of the rectifier bridge are shunted by a series arrangement of a resistor 41 and a zener diode 42. These two output terminals of the rectifier bridge are also shunted by a series arrangement of a rectifier 43, a resistor 44 and a resistor 45. A junction between the resistor 41 and the zener diode 42 is connected to a variable resistor 47. A capacitor 48 and also a main electrode of a controlled semiconductor switching element 49 are also connected to resistor 47. The other side of the capacitor 48 is connected to the negative output terminal of the rectifier bridge 40. The other main electrode of the switching element 49 is also connected to the negative output terminal of the rectifier bridge 40 via a transformer primary winding 50. In combination with the winding 50, the winding 15 forms an output transformer of the control pulse generator. Via a resistor 51 a first control electrode of the switching element 49 is connected to a tap between the resistors 44 and 45. Via a resistor 52 another control electrode of the switching element 49 is connected to a tap between the switching element 49 and the primary transformer winding 50. Finally, the capacitor 48 is shunted by a resistor 53. This ends the description of the control pulse generator.

The described circuit operates as follows. When the terminals 1 and 2 are connected to the indicated a.c. voltage source, a voltage will first be produced across the series arrangement 28, 27, 26. Consequently, point A will reach a certain potential, which is positive relative to the potential of point B. Namely, since the lamp has not yet been ignited, no current will flow yet through the winding 6. This means that the first sensor element, the winding 20, will as yet nor carry current. A direct voltage will be produced between the output terminals of the rectifier bridge 40. This causes the switching element 49 to be periodically rendered conductive, as a result of which pulses will always flow in the same direction through the primary winding 50 and consequently also generate rectified pulses in the secondary transformer winding 15. However, the potential A is still so high that the switching element 12 is rendered conductive, so that the pulses induced in the winding 15 do not reach the control electrode of the switching element 10. This prevents this switching element from becoming conductive.

If the discharge tube 5*a* of the lamp 5 now ignites, a current will start flowing in the winding 6, while the arc voltage and, consequently, also the voltage across the series arrangement 5, 6, starts to increase. The current in the winding 6 now induces a voltage in the secondary winding 20, which starts influencing the potential at point A. The circuit has been dimensioned such that not until the normal operating current flows through the winding 6, and the normal operating arc voltage has been produced across the discharge tube 5*a*, does the potential of the point A become so low that the switching element 12 is no longer rendered conductive. Until then the control pulses coming from the winding 15 will reach the switching element 10 and cause it to conduct briefly during each half cycle.

In a practical embodiment the capacitance of the capacitor 3 is approximately 35 μFarad, the capacity of capacitor 21 is approximately 0.27 μFarad, the capacitance of the capacitor 29 is approximately 1 μFarad, the capacitance of capacitor 48 is approximately 0.27 μFarad. The resistor 13 is approximately 1 KOhm, the resistor 14 is approximately 50 Ohm, the resistor 17 is approximately 10 kOhm, the resistor 23 is approximately 33 kOhm, the resistor 26 is approximately 121 kOhm, the resistor 27 is approximately 274 kOhm, the resistor 41 is approximately 10 kOhm, the resistor 45 is approximately 22 kOhm, the resistor 51 is approximately 22 kOhm, the resistor 52 is approximately 10 kOhm, and the resistor 53 is approximately 100 kOhm. The transformation ratio of the transformer 7 is 1:25. The transformation ratio of the transformer having the windings 50 and 15 is 1:1. Coil 4 has a value of approximately 66 mHenry.

The circuit described results in a quick warming-up of the discharge lamp. The operating condition is reached after approximately 2 minutes. It was possible to make the ballast (3,4) relatively small in view of the operation of the switching element 10.

What is claimed is:

1. An arrangement comprising a gas and/or vapour discharge lamp having a discharge tube, and two terminals which are intended for connection to an a.c. voltage source, in which arrangement the terminals are interconnected by a series arrangement of at least the discharge tube and a stabilization ballast which includes a capacitor, a portion of the series arrangement which includes the discharge tube but not the capacitor is shunted by an electronic auxiliary device, this auxiliary device comprising a branch including a controlled semiconductor switching element provided with a control circuit, the semiconductor switching element being rendered conductive in the operating condition of the lamp in substantially each half cycle of the supply by means of its control circuit, the control of the semiconductor switching element being different during starting of the lamp from that during the operating condition of the lamp, characterized in that the discharge tube is of a type which has an average temperature of at least 200° C. in the operating condition of the lamp, and the control circuit of the semiconductor switching element includes a sensor element coupled to the said series arrangement which reduces the conduction period of the semiconductor switching element per unit of time so long as, in the switched-on condition of the arrangement, the condition of the lamp differs from its operating condition.

2. An arrangement as claimed in claim 1, characterized in that the sensor element consists of a secondary winding of a transformer, and that a primary winding of that transformer is included in the series arrangement interconnecting the terminals of the arrangement and comprising the discharge tube.

3. An arrangement as claimed in claim 2, in which the lamp is of a type for which the arc voltage increases during warming-up of the discharge tube, characterized in that the series arrangement of the discharge tube and the primary winding of the transformer is shunted by the first controlled semiconductor switching element and also by an input branch of a second sensor element, which input branch includes a voltage divider.

4. An arrangement as claimed in claim 3, in which the first semiconductor switching element has a bidirectional thyristor characteristic and its control circuit is provided with a second controlled semiconductor switching element, a control electrode and a main electrode of the first switching element being interconnected via the second switching element and also being connected to a control pulse generator, and a control electrode of the second switching element is connected to an auxiliary power supply and to a circuit comprising the secondary transformer winding such that, the arrangement having been switched on but the lamp current being absent, the second switching element is rendered conductive by means of the auxiliary power supply.

5. An arrangement as claimed in claim 4, characterized in that the auxiliary power supply is provided by a tap on the voltage divider of the second sensor element.

6. An arrangement as claimed in claim 5, characterized in that the secondary transformer winding is shunted by a series arrangement of a second capacitor and a first rectifier, the second capacitor being shunted by a resistor, and a second rectifier is connected to the junction of the second capacitor and the resistor, and a third rectifier which forms part of the auxiliary supply is connected to that second rectifier, the forward directions of the second and third rectifiers facing one another, the other side of the third rectifier being connected to the tap of the voltage divider of the second sensor element, a fourth rectifier being included in series with the voltage divider, a portion of the voltage divider being shunted by a third capacitor, and the connection from the control electrode of the second switching element to the circuit of the secondary transformer winding being connected a junction point between the second and third rectifiers.

7. An electric arrangement as claimed in claim 4, 5 or 6, characterized in that the control pulse generator is also connected to the input terminals of the arrangement and that that control pulse generator comprises an output transformer, the second switching element being connected across the secondary winding of that transformer.

8. An electronic auxiliary device for operating a discharge lamp which is connected in series with a stabilization ballast which includes a capacitor, the device having two input terminals interconnected by a controlled semiconductor switching element, a control circuit of which element comprises two sensor elements, one sensor element including a winding which is intended for electric coupling to a winding in the series circuit of the lamp to be operated with this electronic auxiliary device, the other sensor element comprising a series arrangement of a voltage divider and a rectifier, this series arrangement shunting the semiconductor switching element.

* * * * *